US006802431B2

(12) United States Patent
Schinkel

(10) Patent No.: US 6,802,431 B2
(45) Date of Patent: Oct. 12, 2004

(54) PAINT TRAY WITH HANDLE, SPOUT, AND INCLINED RIBBING INTO PAINT RESERVOIR

(75) Inventor: Andrew Allen Schinkel, Vancouver (CA)

(73) Assignee: Indigo Wind Films Inc., Vancouver (CA)

( * ) Notice: Subject to any disclaimer, the term of this patent is extended or adjusted under 35 U.S.C. 154(b) by 0 days.

(21) Appl. No.: 09/932,820

(22) Filed: Aug. 20, 2001

(65) Prior Publication Data

US 2002/0056714 A1 May 16, 2002

Related U.S. Application Data

(60) Provisional application No. 60/225,640, filed on Aug. 16, 2000.

(51) Int. Cl.[7] ..... B05C 21/00

(52) U.S. Cl. ..... 220/570; 220/698; 220/771; 222/566

(58) Field of Search ..... 220/570

(56) References Cited

U.S. PATENT DOCUMENTS 586,195 A * 7/1897 Monroe ..... 220/23.4
1,622,075 A * 3/1927 Atwater ..... 220/23.4
2,661,858 A 12/1953 Howell
2,917,764 A * 12/1959 Whittle ..... 15/257.06
3,323,677 A * 6/1967 Schraeger ..... 220/756
3,822,846 A 7/1974 Jesionowski
4,023,702 A 5/1977 McKnight
4,164,299 A * 8/1979 Fuhr
4,445,250 A 5/1984 Seidl
5,054,661 A * 10/1991 Hollje ..... 15/257.05
5,511,279 A * 4/1996 Ippolito ..... 15/257.06
5,810,196 A * 9/1998 Lundy ..... 220/23.8
5,956,802 A * 9/1999 Wakat et al. ..... 15/257.05
6,138,963 A * 10/2000 Malvasio ..... 248/111
6,276,554 B1 8/2001 Lallement et al.
6,419,106 B1 * 7/2002 Bebak ..... 220/570
2002/0005409 A1 1/2002 Rosa

* cited by examiner

*Primary Examiner*—Joseph Man-Fu Moy
(74) *Attorney, Agent, or Firm*—Andrew R. Hicks; Borden Ladner Gervais LLP

(57) ABSTRACT

The invention is a plastic, molded paint tray (used in conjunction with roller applicators) with a handle integral to the body, a spout at the reservoir end of the tray, and inclined ribbing on the incline of the tray extending onto the floor of the paint reservoir.

1 Claim, 1 Drawing Sheet

PAINT TRAY WITH HANDLE, AND SPOUT, AND RIDGE-RIBBING INTO PAINT RESERVOIR
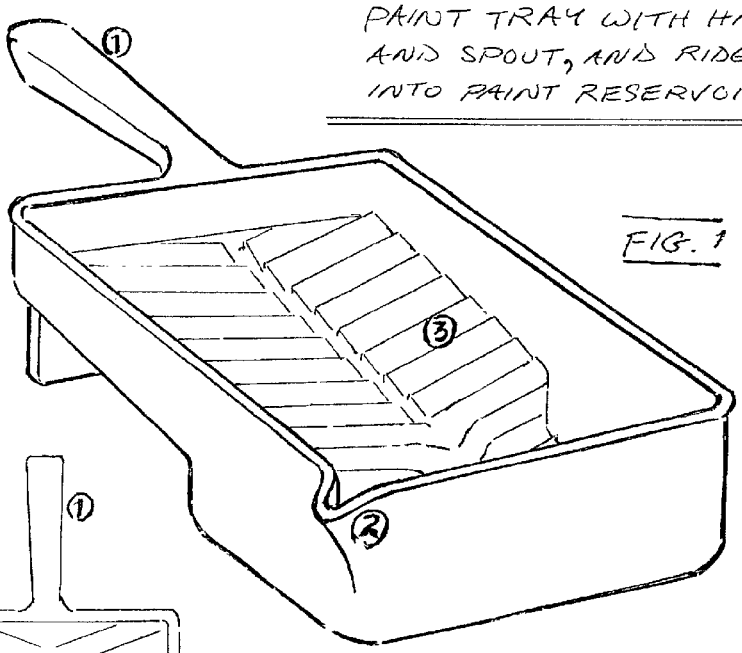
FIG. 1
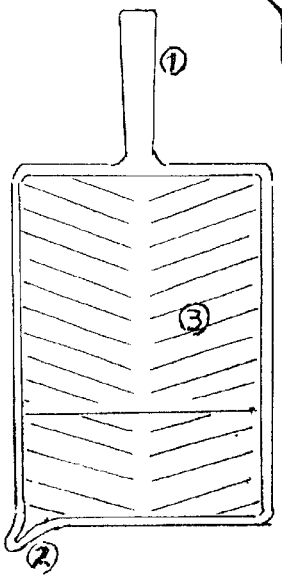
FIG. 2
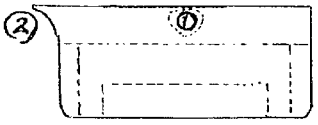
FIG. 3
FIG. 4
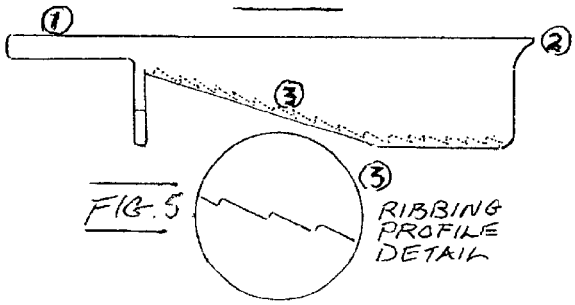
FIG. 5

PAINT TRAY WITH HANDLE, SPOUT, AND INCLINED RIBBING INTO PAINT RESERVOIR

CROSS-REFERENCE TO RELATED APPLICATIONS

Application Ser. No. 60/225,640

Filing Date Aug. 16, 2000

STATEMENT REGARDING FEDERALLY SPONSORED RESEARCH OR DEVELOPMENT

Not Applicable

REFERENCE TO MICROFICHE APPENDIX

Not Applicable

BACKGROUND OF INVENTION

This invention relates to a paint tray commonly made of plastic or metal which commonly has an inclined surface (for paint application to a roller brush) leading to a reservoir for holding paint, with this version having (a) a handle integral to the body of the tray, (b) a spout, and (c) raised ribbing on the inclined surface leading to the reservoir with this series of ribbing leading into and including the floor of the reservoir.

The obvious, first shortcoming of commonly known paint trays is that they function in a stationary position, placed on the floor or top of table or affixed in some manner to a ladder except for some smaller trays which may be awkwardly held by hand. With my invention, the handle which is integral to the body of the tray, allows the tray to be held in one hand and carried while painting with a roller in the other hand, enabling the paint roller to be loaded with paint while the tray is being held. Also, the commonly known tray (without a handle) will slide about, being pushed by the roller when attempting to load the roller with paint. This tray has to be awkwardly steadied, often getting paint on one's hands. This especially occurs with smaller trays used with a four to six inch wide roller. The handle on my invention allows one to steady the tray when loading the roller with paint facilitating easier and more efficient loading of the roller while keeping one's hands free of paint drips from the tray.

In commonly known paint trays, when unused paint is poured back into the original container, it often pours out undirected and spills or drips on the underside of the tray. The second feature of my invention is a spout at a corner end of the paint reservoir which enables unused paint to be poured cleanly back into the original container.

In commonly known paint trays. when attempting to load the roller with the paint remaining on the floor of the tray reservoir, the paint roller tends to slide back and forth unless delicately maneuvered to have it roll in an effort to load the roller. The third feature of my invention is an inclined ribbing on the floor of the reservoir as a continuation of the ribbing on the incline leading from the reservoir. This ribbing, being a series of inclines which form ridges, increases the grippage of the roller facilitating loading the roller with paint.

The above three improvements apply to trays of varying sizes and proportions appropriate for paint rollers two to ten inches in width.

BRIEF SUMMARY OF INVENTION

The invention is a plastic paint tray (used with roller paint applicators) incorporating a handle integral to the body of the tray to facilitate carrying the tray while painting, a spout at the reservoir end of the tray to facilitate pouring unused paint back into the original container, and an inclined ribbing on the inclined surface leading from the paint reservoir of the tray which extends onto the floor of the reservoir.

BRIEF DESCRIPTION OF THE SEVERAL VIEWS OF THE DRAWING

In the supplied drawings which illustrate the embodiments of the invention,

FIG. 1 is a general perspective,

FIG. 2 is a top view,

FIG. 3 is an end view (handle end),

FIG. 4 is a side view, and

FIG. 5 is a detail of the ribbing.

The embodiments for all drawings are designated as follows: (1) HANDLE, (2) SPOUT, (3) INCLINED RIBBING.

DETAILED DESCRIPTION OF THE INVENTION

This invention is a paint tray constructed of molded plastic for use with roller applicators. It has a handle integral to the body of the tray at the end opposite the paint reservoir. The invention has a spout at one corner of the paint reservoir end of the tray. The tray has raised and inclined ribbing on the applicator incline leading away from the reservoir. This inclined ribbing extends onto the floor of the reservoir.

The embodiment of the invention in which an exclusive property or privilege is claimed are defined as follows:

1. A paint tray comprising:

an open reservoir having first and second end walls, first and second side walls and a floor;

an inclined surface integral with the open reservoir, the inclined surface extending between the floor and the first end wall, the inclined surface and floor having a ribbed surface;

a handle having a shaft adapted for one-handed gripping, the shaft having a first end attached to the first end wall and extending outwardly midway between the first and second side walls in a direction parallel to the reservoir floor and the first and second side walls;

an extending spout integral with the upper edge of the reservoir wall at the junction between the second end wall and one of the first or second end walls; and, a supporting leg on the underside of the inclined surface.

* * * * *